US005913484A

United States Patent [19]

Kurtz

[11] Patent Number: 5,913,484

[45] Date of Patent: Jun. 22, 1999

[54] FOOD CHOPPER

[75] Inventor: Theobald Kurtz, Balve, Germany

[73] Assignee: Gebruder Funke KG, Eslohe/Sauerland, Germany

[21] Appl. No.: 09/026,511

[22] Filed: Feb. 19, 1998

[51] Int. Cl.[6] ..... B02C 18/18

[52] U.S. Cl. ..... 241/73; 241/100; 241/243

[58] Field of Search ..... 241/73, 100, 243, 241/292.1

[56] References Cited

U.S. PATENT DOCUMENTS

| | | | |
|---|---|---|---|
| 1,621,823 | 3/1927 | Ayres | 241/73 |
| 3,083,746 | 4/1963 | Fenton | 241/73 |

FOREIGN PATENT DOCUMENTS

| | | | |
|---|---|---|---|
| 107 295 | 2/1899 | Germany . | |
| 162 584 | 2/1903 | Germany . | |
| 183 155 | 6/1906 | Germany . | |
| 885 467 | 6/1953 | Germany . | |
| 1606186 | 11/1990 | U.S.S.R. | 241/73 |

*Primary Examiner*—Mark Rosenbaum
*Attorney, Agent, or Firm*—Herbert Dubno; Andrew Wilford

[57] ABSTRACT

A food chopper has a housing having side walls and a generally semicylindrical floor formed with holes and having an inner surface generally centered on a horizontal axis and a shaft journaled in the side walls at the axis for rotation about the axis. Respective elongated elements spaced axially apart along the axis extend radially of the axis and each have an inner end fixed at the axis and an outer end fixed in the floor. A plurality of U-shaped cutters are each unitarily formed with a pair of axially spaced parallel side blades each having an inner end fixed on the shaft and an outer end and a respective end blade extending substantially parallel to the axis between the respective outer cutter-blade ends. The side blades are of such a length that on rotation of the shaft the end blades sweep closely along the floor inner surface. The shaft can be rotated to orbit the cutters about the axis and past the elongated elements.

11 Claims, 3 Drawing Sheets

FOOD CHOPPER

FIELD OF THE INVENTION

The present invention relates to a food chopper. More particularly this invention concerns a manual food chopper intended to comminute mainly vegetables, fruits, and the like.

BACKGROUND OF THE INVENTION

A standard food chopper as described in German patent 885,467 of Muller comprises a housing having side walls and a generally semicylindrical floor formed with holes and having an inner surface generally centered on a horizontal axis, a shaft journaled in the side walls at the axis for rotation about the axis, respective elongated elements spaced axially apart along the axis, extending radially of the axis, and each having an inner end fixed at the axis and an outer end fixed in the floor, and a plurality of cutter blades spaced axially along the shaft, fixed thereto, and extending radially therefrom. Thus the shaft can be rotated to orbit the cutter blades and thereby chop material against the elongated elements, which may be fixed blades. The material is chopped finer and finer until the bits can pass through the perforated floor.

Other such choppers disclosed, for example, in German patent 107,295 of Sichel, German patent 162,584 of Brunner, or German patent 183,155 of Schwetz, work similarly. All have the tendency to clog or to recirculate the material being chopped until it is mushy. Most need to be meticulously emptied and cleaned, even in the middle of chopping, for instance, a pile of onions, since material clogs the perforated floor or outlet plate.

OBJECTS OF THE INVENTION

It is therefore an object of the present invention to provide an improved food chopper.

Another object is the provision of such an improved food chopper which overcomes the above-given disadvantages, that is which does not jam or clog.

SUMMARY OF THE INVENTION

A food chopper has according to the invention a housing having side walls and a generally semicylindrical floor formed with holes and having an inner surface generally centered on a horizontal axis and a shaft journaled in the side walls at the axis for rotation about the axis. Respective elongated elements spaced axially apart along the axis extend radially of the axis and each have an inner end fixed at the axis and an outer end fixed in the floor. A plurality of U-shaped cutters are each unitarily formed with a pair of axially spaced parallel side blades each having an inner end fixed on the shaft and an outer end and a respective end blade extending substantially parallel to the axis between the respective outer cutter-blade ends. The side blades are of such a length that on rotation of the shaft the end blades sweep closely along the floor inner surface. The shaft can be rotated to orbit the cutters about the axis and past the elongated elements.

The U-shaped open cutters according to the invention are extremely effective in cutting through and comminuting hard vegetables and the like, e.g. onions, and are virtually impossible to clog. The end blades sweep along the perforated floor so that anything projecting through the holes therein will be cut off, clearing any obstruction. Chunks that are too big to pass through the holes are forced between the elongated elements, which according to the invention are formed as fixed blades with inner ends traversed by the shaft and outer ends seated in the floor, so that these chunks are recut and orbited around to be cut again until they are reduced to bits small enough to pass through the holes in the floor.

In accordance with the invention the cutters are angularly offset about the axis relative to one another. In addition each elongated element is a flat radially extending fixed blade lying generally in a plane perpendicular to the axis and each side blade of each cutter is also flat and lies generally in a respective plane perpendicular to the axis. Furthermore, each fixed blade is closely axially flanked by two side blades of two flanking cutters. Each cutter is unitarily formed of a bent strip of spring steel. In addition each side and end cutter and each fixed blade has parallel oppositely directed sharp edges so that rotation in either direction is effective to chop and clearing anything like a pit or fibrous mass is simply a matter of reversing shaft rotation direction.

The inner end of each flat blade according to the invention is formed with a hole through which the shaft extends loosely. Furthermore the floor is formed with row of respective axially spaced seats holding the outer ends of respective fixed blades. The housing forms an upper chamber above and a lower chamber below the floor and the rotating means is a hand crank mounted on the shaft.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
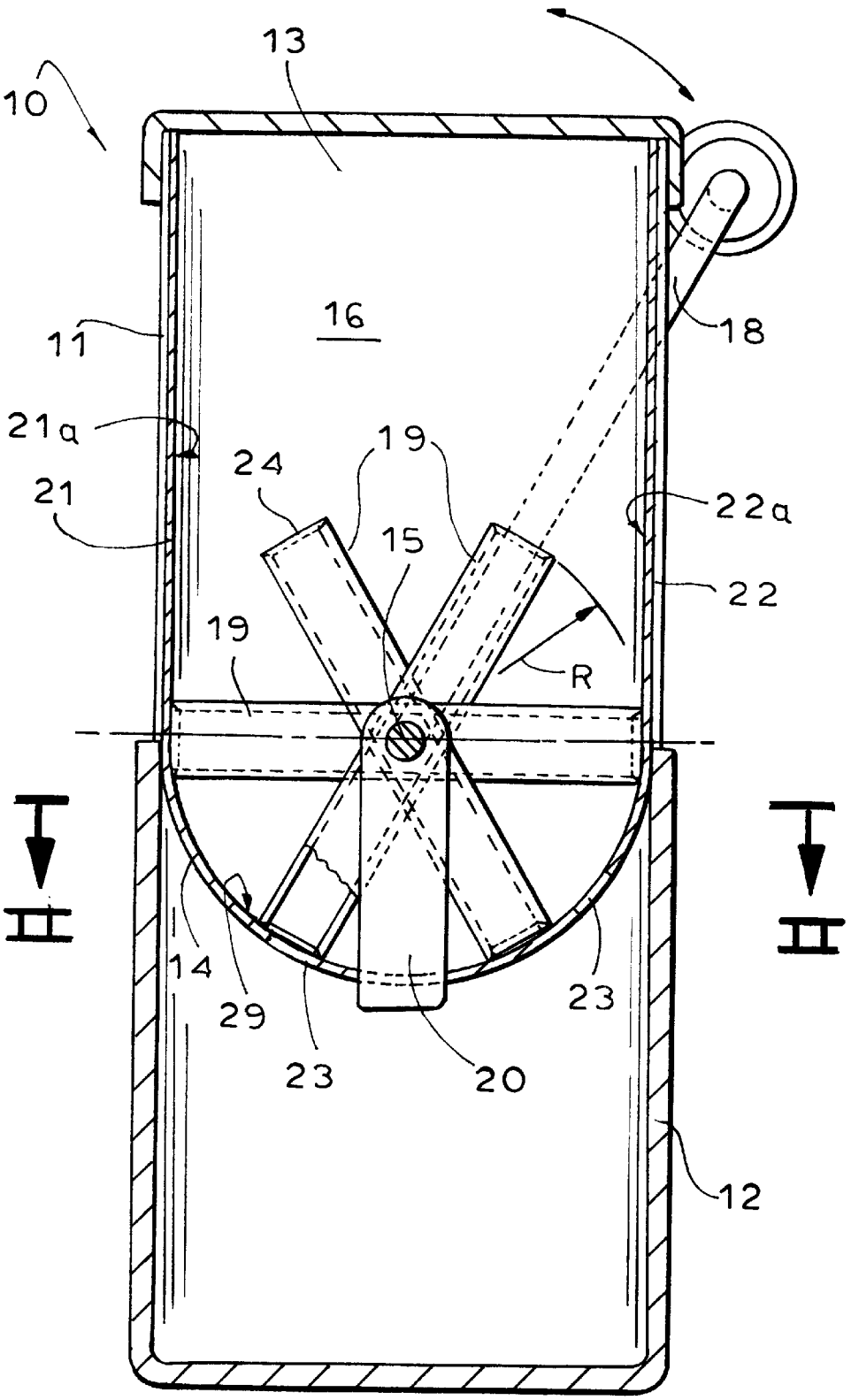
FIG. 1 is a vertical section through the chopper according to the invention

As seen in FIG. 1 a food chopper according to the invention has a generally closed housing or casing 10 of parallepipedal shape divided into an upper part 11 that is mainly metallic and a lower part 12 that is normally formed of decorative or clear plastic. The upper part 11 has upright side end walls 16 and 17 (FIGS. 2 and 3), upright front and back side walls 21 and 22 bridging the end walls 16 and 17, and a removable lid 13. A semicylindrically arcuate metallic floor 14 having an inner surface 29 and formed with a uniform array of throughgoing holes or apertures 23 closes the bottom of a chamber 32 formed inside the upper part 11. The lower part 12 forms a chamber 33 therebelow.

Figure 3:
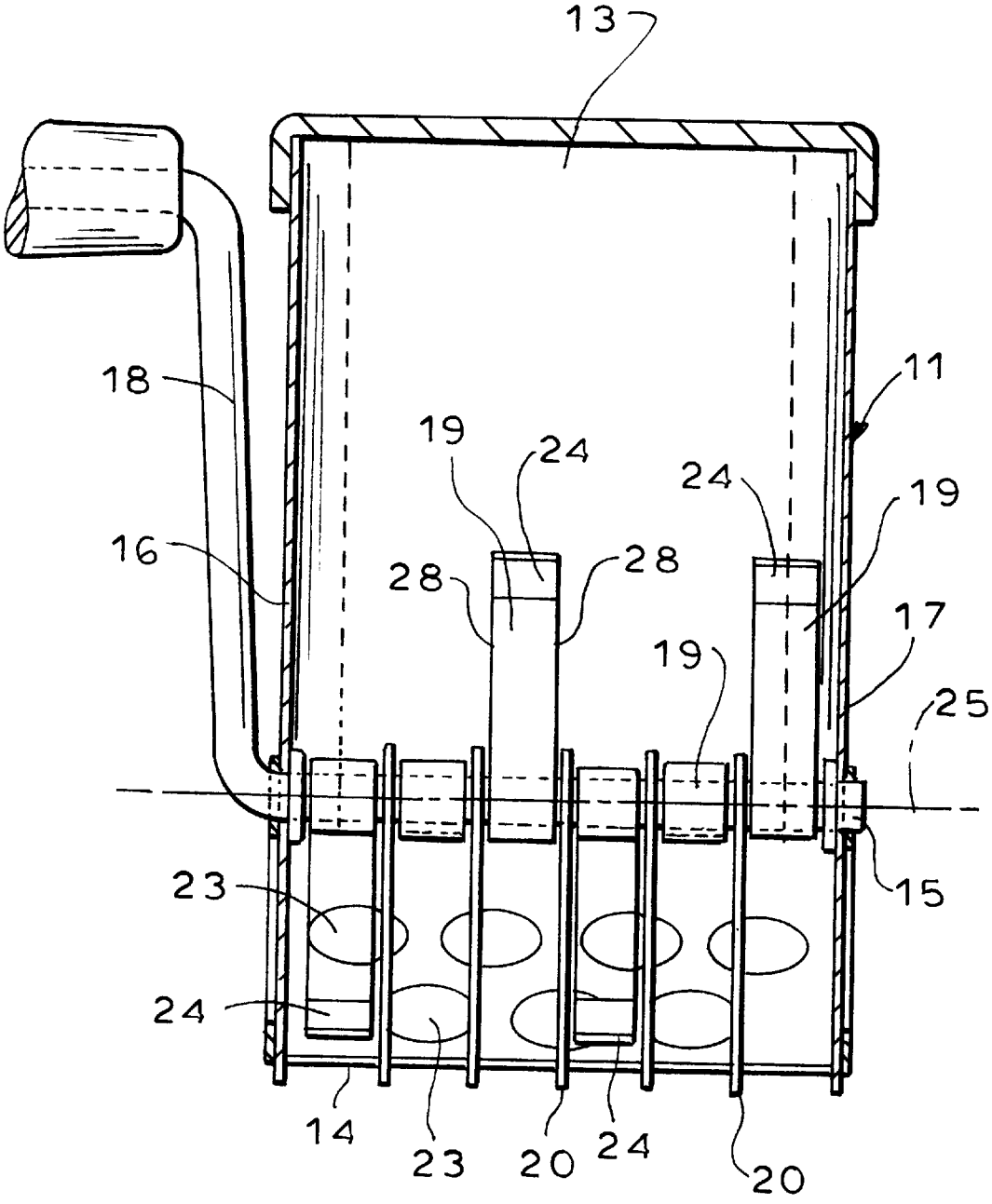
FIG. 3 is a vertical section taken along line III—III of FIG. 2 so that the section of FIG. 3 is at a right angle to that of FIG. 1.

As best seen in FIGS. 1 and 3 a shaft 15 is journaled in the side walls 16 and 18 for rotation about a horizontal axis 25 that is also the center of curvature of the surface 29 and is extended at one end as a hand crank 18. This shaft 15 carries inside the housing 10 six identical but axially spaced U-shaped cutters 19 made of spring steel and each having a crosswise and planar end blade 24 extending parallel to the axis 25 and a pair of planar and straight arms 28 extending in planes perpendicular thereto. These cutters 19 have a length R measured as a radius from the axis 15 to an outer face of the end blade 24 that is equal to slightly less than the radial distance from the axis 25 to the inner surface 29 of the floor 14. In addition the cutters 19 are fixed on the shaft 15 to be angularly equispaced about this axis 25, here at 60° to one another. The opposite edges of the end blades 24 and arms 28 are sharpened.

Figure 2:
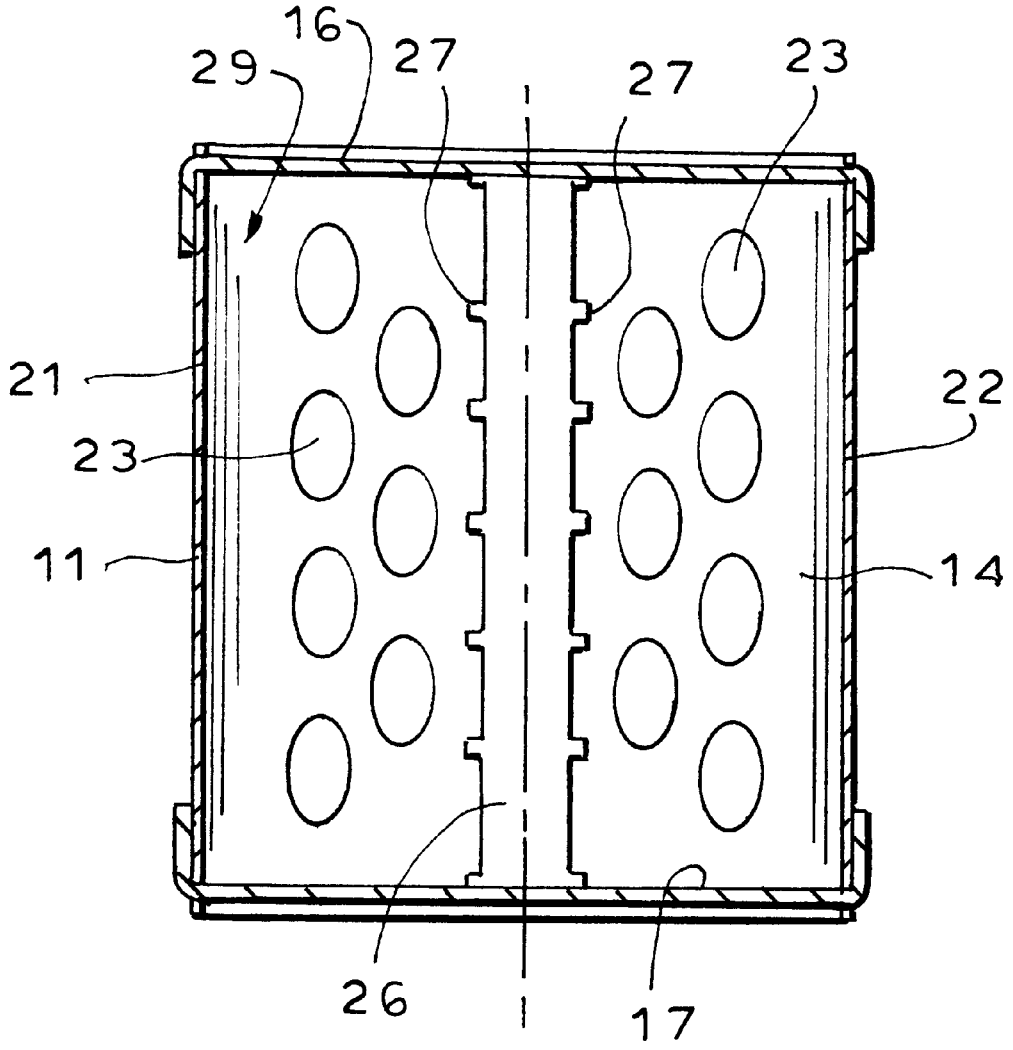
FIG. 2 is a horizontal section taken along line II—II of FIG. 1.

The floor 14 is formed as best shown in FIG. 2 (where no cutters 29 or blades 20 are shown for clarity of view) with a central gap 26 just underneath the central axis 25 and the facing edges of the gap 26 are each in turned formed with five notch seats 27. Fixed cutter blades 20 have inner ends formed with eyes 31 fitting loosely over the shaft 15 and outer ends that are each seated in a facing pair of the notch seats 27. These blades 20 therefore lie in respective planes perpendicular to the axis and have opposite generally radially extending sharpened edges. Short spacer tubes 30 are fitted over the shaft 15 between the arms 28 of the cutters 19 and the cutters 20 so that each cutter 20 is sandwiched between the arms 24 of two flanking cutters 19.

With this system an onion, hard-boiled egg, or the like to be chopped is dropped into the chamber 32 after removal of the lid 13 and the crank 18 is actuated to rotate the entire cutter assembly formed by the blades 19 and shaft 15 about the axis 25. This will normally pinch the material being chopped against an inner face 21*a* or 22*a* of the front or back wall 21 or 22, depending on rotation direction of the crank 18, and will force this material down into one of the lower quadrants defined between the fixed blades 20 and the floor 14. The leading edges of the movable cutters 19 will cut through the material and press it against the sharp edges of the fixed cutter blades 20 which will cut through in the opposite angular direction. At the same time the end blades 24 will sweep across the surface 29, cutting off anything projecting through the holes 23 so it drops down into the compartment 33. The bigger chunks will get pushed through between the blades 20 and will orbit around to be cut again and again until they are reduced to bits small enough to pass through the holes 23 or through the gap 26 between the blades 20. The blades 20 subdivide the gap 26 into apertures of roughly the same size as the holes 23 so that food can pass through here to. Any liquid generated by crushing and cutting will flow easily down and out through the two-part apertured floor 14.

I claim:

1. A food chopper comprising:

a housing having side walls and a generally semi-cylindrical floor formed with holes and having an inner surface generally centered on a horizontal axis;

a shaft journaled in the side walls at the axis for rotation about the axis;

respective elongated elements spaced axially apart along the axis, extending radially of the axis, and each having an inner end fixed at the axis and an outer end fixed in the floor;

a plurality of U-shaped cutters each unitarily formed with a pair of axially spaced parallel side blades each having an inner end fixed on the shaft and an outer end, and a respective end blade extending substantially parallel to the axis between the respective outer cutter-blade ends, the side blades being of such a length that on rotation of the shaft the end blades sweep closely along the floor inner surface; and means connected to the shaft for rotating same about the axis and thereby orbiting the cutters about the axis and past the elongated elements.

2. The food chopper defined in claim 1 wherein the cutters are angularly offset about the axis relative to one another.

3. The food chopper defined in claim 1 wherein each elongated element is a flat radially extending fixed blade lying generally in a plane perpendicular to the axis and each side blade of each cutter is also flat and lies generally in a respective plane perpendicular to the axis.

4. The food chopper defined in claim 3 wherein each fixed blade is closely axially flanked by two side blades of two flanking cutters.

5. The food chopper defined in claim 4 wherein each cutter is unitarily formed of a bent strip of spring steel.

6. The food chopper defined in claim 4 wherein each side and end cutter has parallel oppositely directed sharp edges.

7. The food chopper defined in claim 4 wherein each fixed blade has parallel oppositely directed sharp edges.

8. The food chopper defined in claim 4 wherein the inner end of each flat blade is formed with a hole through which the shaft extends loosely.

9. The food chopper defined in claim 4 wherein the floor is formed with row of respective axially spaced seats holding the outer ends of respective fixed blades.

10. The food chopper defined in claim 1 wherein the housing forms an upper chamber above and a lower chamber below the floor.

11. The food chopper defined in claim 1 wherein the means is a hand crank.

* * * * *